United States Patent [19]

Henderson et al.

[11] Patent Number: 4,770,701

[45] Date of Patent: Sep. 13, 1988

[54] METAL-CERAMIC COMPOSITES AND METHOD OF MAKING

[75] Inventors: Richard S. Henderson; Michael A. Tenhover, both of Solon, Ohio

[73] Assignee: The Standard Oil Company, Cleveland, Ohio

[21] Appl. No.: 857,882

[22] Filed: Apr. 30, 1986

[51] Int. Cl.[4] ..... C22C 29/02; C22C 29/12; C22C 29/14; C22C 29/16

[52] U.S. Cl. ..... 75/232; 75/235; 75/236; 75/239; 75/240; 75/244; 419/12; 419/13; 419/14; 419/17; 419/18; 419/19; 419/45

[58] Field of Search ..... 75/232, 233, 235, 236, 75/238, 239, 240, 241, 242, 246; 419/12, 13, 15, 16, 17, 18, 19, 45, 14

[56] References Cited

U.S. PATENT DOCUMENTS

| | | | |
|---|---|---|---|
| 3,816,081 | 6/1974 | Hale | 75/242 |
| 4,046,517 | 9/1977 | Soya | 75/242 |
| 4,059,441 | 11/1977 | Ray et al. | 148/403 |
| 4,133,679 | 1/1979 | Ray | 148/403 |
| 4,133,681 | 1/1979 | Ray | 148/403 |
| 4,133,682 | 1/1979 | Ray | 148/403 |
| 4,210,443 | 7/1980 | Ray | 148/403 |
| 4,318,738 | 3/1982 | Masumoto et al. | 148/403 |
| 4,365,994 | 12/1982 | Ray | 148/403 |
| 4,405,368 | 9/1983 | Ray et al. | 148/403 |
| 4,410,490 | 10/1983 | Ray et al. | 420/454 |
| 4,419,130 | 12/1983 | Slaughter | 75/246 |
| 4,439,236 | 3/1984 | Ray | 75/123 |
| 4,451,292 | 5/1984 | Hall et al. | 75/242 |
| 4,473,402 | 9/1984 | Ray et al. | 75/238 |
| 4,481,034 | 11/1984 | Grant et al. | 75/246 |
| 4,490,329 | 12/1984 | Hare et al. | 148/403 |
| 4,497,660 | 2/1985 | Lindholm | 75/242 |
| 4,514,224 | 4/1985 | Nishigaki | 75/241 |
| 4,574,011 | 3/1986 | Bonjour et al. | 75/241 |
| 4,578,123 | 3/1986 | Schultz et al. | 148/403 |
| 4,592,781 | 6/1986 | Cheney et al. | 419/48 |
| 4,606,767 | 8/1986 | Nagato | 75/242 |
| 4,621,031 | 11/1986 | Scruggs | 428/551 |
| 4,636,252 | 1/1987 | Yoshimura et al. | 75/242 |

OTHER PUBLICATIONS

"Influence of Heat Treatment on the Bond Strength of Codeposited Ni-SiC Composite Coatings", M. Ghouse, Surface Technology, 21(1984), 193-200.

"Sediment Codeposition-A New Technique for Occlusion Plating", M. Viswanathan et al., Metal Finishing, vol. 70, pp. 83-84, 1972.

"Chemically Deposited Composites-A New Generation of Electroless Coatings", Hubbell, Plating and Surface Finishing, Dec. 1978, pp. 58-62.

"Mechanical, Thermal and Tribological Properties of Electro- and Chemodeposited Composite Coatings", Broszeit, Thin Solid Films, 95(1982), pp. 133-142.

"Developments in Titanium Metal Matrix Composites", Smith and Froes, Journal of Metals, Mar. 1984, pp. 19-25.

*Primary Examiner*—John F. Terapane
*Assistant Examiner*—Eric Jorgensen
*Attorney, Agent, or Firm*—Sue E. Phillips; Joseph G. Curatolo; Larry W. Evans

[57] ABSTRACT

Amorphous metal-ceramic and microcrystalline metal-ceramic composites are synthesized by solid state reaction-formation methods. These metal-ceramic composites are characterized by a composition that ranges from about 75 to about 99.9 percent ceramic in about 0.1 to about 25 percent amorphous or microcrystalline metal binder phase.

6 Claims, No Drawings

METAL-CERAMIC COMPOSITES AND METHOD OF MAKING

FIELD OF THE INVENTION

This invention relates to novel amorphous metal-ceramic and microcrystalline metal-ceramic composites and to a method of synthesizing such composites. More specifically, this invention relates to novel metal-ceramic composites having a dual microstructure comprising ceramic particles and an amorphous or microcrystalline solid matrix binder.

BACKGROUND OF THE INVENTION

Conventional ceramic materials are used extensively in industry as engineered materials and products. They are very hard materials with good thermal resistance and corrosion resistance. They tend, however, to incorporate defects during formation processes, which lead to strength faults under specified temperature and pressure conditions. These materials, while they are very hard, are also very brittle. This results in splintering and cracking upon sudden or rapid loss in temperature, or upon impact with another material of high hardness.

A metal can be used to supplement conventional ceramic materials to compensate for a particular deficiency which hinders use of ceramic materials for a specified purpose. Such deficiencies might include brittleness, susceptibility to thermal shock and formation defects. Carefully selected metal components may cure one or several of these deficiencies. The resulting composite material will better withstand high temperature, and display less rigid and more ductile characteristics with less tendency to fracture when struck hard or cooled or heated rapidly.

Metal reinforced ceramic composites are well known and are important in the ceramic industry for high temperature engineering components, such as components in gas turbine and diesel engines, where rapid temperature change stability, high temperature strength, and creep resistance are necessary. Metal-ceramic composites generally possess high tensile strength, high thermal stability and high ductility. They differ from conventional ceramic materials in that they are much less brittle and are less prone to the formation of extended defects within the material than are conventional ceramics. Further, conventional ceramics do not have the compositional range of metal-ceramic composites. The addition of a metal alloy to the ceramic material adds both toughness and ductility, resulting in a metal-ceramic composite which can be conformed to a desired shape and is much tougher than the same item formed from conventional ceramic material. The degree to which a given metal-ceramic composite possesses given mechanical and physical properties is dependent on the exact elemental composition of that composite, as different elements contribute different properties in varying degrees. These materials are of special interest for use in applications requiring wear and corrosion resistance and high mechanical strength at high temperatures.

Known metal-ceramic compositions have thus far been limited to crystalline solids, and the development of such composites has been based on the performance characteristics of the crystalline components. These known composites are often synthesized by physically mixing the ceramic and metal components, or by depositing one component into a matrix of the other. Mohammad Ghouse has discussed the use of Ni-SiC crystalline composites as a coating on steel in "Influence of Heat Treatment on the Bond Strength of Codeposited Ni-SiC Composite Coatings," *Surface Technology,* 21 (1984), 193–200. Ghouse uses a heat treatment to bond the composite to the substrate after codeposition of the composite components.

M. Viswanathan et al., of the Indian Institute of Technology, reported on sediment codeposition involving nonmetallic particles being incorporated into a metal phase by keeping the nonmetallic particles in suspension by agitation in an electrolyte while the metal is deposited on a host surface. *Metal Finishing,* "Sediment Codeposition - A New Technique for Occlusion Plating," Vol. 70, 1972, pg. 83–84.

The use of metal-ceramic composites as coatings is discussed by F. N. Hubbell in the December, 1978 issue of *Plating and Surface Finishing,* pages 58–62, "Chemically Deposited Composites - A New Generation of Electroless Coatings," as well as by E. Broszeit, "Mechanical, Thermal and Tribological Properties of Electro - and Chemodeposited Composite Coatings," *Thin Solid Films,* 95 (1982), 133–142. These articles disclose metal-ceramic coating compositions and means of coating application.

Developments in the field of metal matrix composites, and needs not yet met are reported in the *Journal of Metals,* Mar. 1984, pages 19–25, "Developments in Titanium Metal Matrix Composites," by Smith and Froes. Hot isostatic pressing, and vacuum hot pressing are among the reported techniques for composite production. Here, as above, the composites disclosed are crystalline metal composites. Amorphous metal composites and microcrystalline metal composites are not contemplated by these disclosures.

Recently, however, amorphous metals have been given close scrutiny by the technical community due to their unique characteristics. They can be formulated to possess high compositional diversity due to the high free energy state of the initial components. Such compositional diversity makes possible incorporation of various characteristics and properties into the resultant material. The individual components selected will dictate what characteristics and properties are imparted to the amorphous metal. Amorphous metals are also highly resistant to corrosion and wear, and possess high mechanical strength and thermal stability, as well as ductility. These properties make amorphous metals prime candidates for use in metal-ceramic composites to compensate for ceramic material deficiencies.

Microcrystalline metals are also of interest for use in metal-ceramic composites. They possess high thermal stability, high tensile strength and high ductility, as well as being corrosion and wear resistant. The range of compositions which can be attained in microcrystalline formulations, in conjunction with the properties just mentioned, makes incorporation of microcrystalline metals into ceramic materials, to form a microcrystalline metal-ceramic composite, a desirable means for correction of ceramic material deficiencies.

What is lacking in the area of metal-ceramic composites is novel composites incorporating amorphous and microcrystalline metals and a simple process for the direct formation of a large variety of amorphous metal-ceramic and microcrystalline metal-ceramic compositions. Especially lacking is a simple process that would synthesize these novel metal-ceramic composites directly as powders which may undergo heat treatment to produce a desired shape or form without the attendant extended defects and brittleness associated with conventional ceramic materials that are not enhanced by metal components.

Hence, it is one object of the present invention to provide novel amorphous metal-ceramic composites and novel microcrystalline metal-ceramic composites.

It is another object of the present invention to provide a simple process for the preparation of a large variety of homogeneous amorphous metal-ceramic composites and microcrystalline metal-ceramic composites.

These and additional objects of the present invention will become apparent in the description of the invention and examples that follow.

SUMMARY OF THE INVENTION

The present invention relates to novel amorphous metal-ceramic composites, novel microcrystalline metal-ceramic composites, and a process for the synthesis of amorphous metal-ceramic and microcrystalline metal-ceramic composites comprising intimately mixing alloying elements in the presence of ceramic particles and heat-treating this mixture to initiate a solid state reaction-formation, which reaction-formation yields a dual-phase microstructure composed of ceramic particles held together by an amorphous or microcrystalline solid matrix binder.

DETAILED DESCRIPTION

In accordance with this invention, there are provided novel amorphous metal-ceramic and novel microcrystalline metal-ceramic compositions synthesized by heat treatment of the metal alloy components in the presence of ceramic particles. The heat treatment of this mixture initiates a solid state reaction-formation process. The phrase "metal-ceramic composite" refers to a fine-grained material wherein the metal phase of the material is an amorphous metal-containing alloy or a microcrystalline alloy. The phrase "amorphous metal" connotes amorphous metal-containing alloys that may also comprise non-metallic elements wherein the alloy is at least about 50 percent amorphous, preferably at least about 80 percent amorphous, and most preferably about 100 percent amorphous. The term "microcrystalline" refers to an alloy material characterized by a crystalline grain size of from about 0.01 microns to about 1.0 microns.

In accordance with the present invention, a metal and a ceramic are combined in such a manner that the metal exists in an amorphous or microcrystalline state as a binder disposed between adjacent ceramic particles.

Preferred ceramic components include SiC, $TiB_2$, WC, AlN, $Si_2N_3$, TiC, TiN, VC, VN and combinations thereof. The ceramic component may be used in various forms, such as in powder form, or as a fiber, platelet, pellet, or sheet. Regardless of the form used, the size of the ceramic body, the surface of which will chemically react with the metal component to form the amorphous or microcrystalline phase of the resultant composite, will be about 0.1 to about 100 microns.

Preferred metal components include alloys of Fe, Ni, Co, Cu and combinations thereof. This component is chosen such that once it is deposited upon the ceramic surface and heat-treatment is initiated, it will readily react with the ceramic material. Therefore, metal-ceramic component pairings should reflect a difference in reactivity properties of the two components sufficient to supply the energy necessary to commence the reaction and drive it to completion. The metal component, which will be precipitated onto the ceramic surface, will be about 10 to about 1,000 Angstroms thick. This component should be chosen to compensate for at least one deficiency of the ceramic material, such as brittleness and/or formation defects. A metal may be added to compensate for brittleness by supplying flexibility and ductility which will allow the composite to absorb expansion and contraction reactions due to rapid temperature change, or to absorb the shock when hit solidly by another hard material.

The composite synthesized by the subject inventive method will consist of a thin film of amorphous or microcrystalline metal material disposed on the surface region of larger ceramic particles. This thin film acts as a binder between adjacent ceramic particles. The amount of metal incorporated into the surface region of the ceramic material in the form of amorphous or microcrystalline phase matrix binder must be controlled such that the resultant amorphous or microcrystalline film is distributed uniformly and evenly around the ceramic material surface between adjacent ceramic particles. This insures homogeneity in the resultant composite, and enhances composite stability with respect to both composition and performance.

The metal may be contacted with the ceramic material by conventionally known and practiced deposition techniques, including chemical reaction, electrodeposition, electroless deposition, and physical deposition techniques.

The composite formed will consist of metal alloy binder and ceramic particles. The metal alloy material is totally reacted with the surface region of larger ceramic particles to form a binder. Reaction of the ceramic particles with the metal alloy material is limited to the surface region of these particles, with the central region of the particles maintaining their ceramic characteristic. The metal phase is either amorphous or microcrystalline, depending on the combination of ceramic and metal components and the temperature and length of the heat-treatment. This dual-phase composite material will appear as a thin amorphous or microcrystalline film binder coating each ceramic particle and binding each ceramic particle to every adjacent ceramic particle, such that the composition of the composite ranges from about 75 to about 99.9 percent ceramic and from about 0.1 to about 25 percent binder material. This thin film amorphous or microcrystalline phase imparts thermal and physical shock absorption properties to the microstructure, thus preventing fracturing, splintering, or cracking of the composite material.

The present invention synthesizes amorphous metal-ceramic and microcrystalline metal-ceramic composites by solid state reaction methods. Such methods insure homogeneity and uniformity of composition. These methods involve impinging the metal component evenly on the ceramic particle surface and applying heat to initiate the solid state reaction between the metal and ceramic components. The metal may be deposited on the ceramic surface by any conventional method of so doing, such as chemical reaction, electrodeposition, or physical deposition methods. After this is accomplished, there exists a mixture of ceramic and metal particles, the metal particles having been impinged on the surface of the ceramic particles. Upon heat-treatment of this mixture, the metal and ceramic particles chemically react, causing a diffusion of one into the other. The result of this reaction is a composite material composed of ceramic particles held together by a matrix binder that is either an amorphous or a microcrystalline metal. A portion of the surface of the ceramic particle is incorporated into the amorphous metal phase or microcrystalline metal phase and the remainder of the ceramic material remains substantially unaltered by the diffusion process.

An example of a solid state reaction such as that referred to above is disclosed in U.S. Ser. No. 751,704, entitled "Amorphous Metal Alloy Compositions and Synthesis of Same by Solid State Incorporation/Reduction Reactions." This process comprises contacting a high surface area support material with a precursor metal-bearing compound such that the metal-bearing compound is disposed on the high surface area support and combines to form the amorphous metal alloy. More specifically, the solid state reaction disclosed involves causing the precursor metal-bearing compound to deposit metal onto the high surface area support material. The precursor compound is selected to decompose at a temperature below the crystallization temperature of the amorphous alloy to be formed. The deposited metal then reacts with the high surface area support to form the amorphous metal alloy. Alternatively, the metal may be disposed on the high surface area support by reduction of the metal-bearing precursor, by either reducing agent or by electrochemical or photocatalytic reduction, in the presence of the high surface area support. Heat treatment subsequent to disposition of the metal onto the support will yield the amorphous metal alloy.

Further, heat-treatment of the amorphous metal alloy produced will yield a microcrystalline phase alloy of equivalent composition to that of the amorphous alloy. This further heat treating process to form the microcrystalline phase is disclosed in U.S. Ser. No. 815,429, to our common assignee entitled "Microcrystalline Alloys Prepared from Solid State Reaction Amorphous or Disordered Metal Alloy Powders."

The composite material synthesized by the method of this invention will embody variations in composition due to the high free energy of the metal phase material. Solid state reaction processes, such as that disclosed above, increase the range of compositions that will exist in any given amorphous metal-ceramic or microcrystalline metal-ceramic composite. By increasing the range of compositions, a commensurate increase in the range of properties, characteristic of different compositions, is achieved, thus making solid state reactions desirable for amorphous metal-ceramic and microcrystalline metal-ceramic composite production.

This technique is suitable for any ceramic material, oxide or non-oxide, and the choice of alloy-forming elements is determine by the type of alloy phase one wishes to synthesize. These elements can include both transition and non-transition elements, or combinations thereof. As was previously stated, the ease of solid state reaction initiation is highly dependent upon the reactivity of the metal-ceramic combination. Thus, elements of varying reactivity properties should be combined. Exemplary combinations include but are not limited to SiC, $TiB_2$, WC, AlN, $Si_2N_3$, TiC, VC and VN.

The solid state reaction can take place at below atmospheric pressure, atmospheric pressure or above atmospheric pressure, and in an inert or a reactive atmosphere. The temperature at which the reaction is carried out can range from about 0.5 to about 2.0 of the glass transition temperature (Tg) of the composite, wherein within that range, and depending on time-temperature treatment, an amorphous metal-containing composite will be obtained between about 0.5 and about 0.8 Tg, and a microcrystalline metal-containing composite will result between about 0.8 and about 2.0 Tg. Of course, heat treatment at the high end of the amorphous metal-containing composite range for extended periods of time will eventually yield a microcrystalline metal-containing composite instead of an amorphous metal-containing composite.

Amorphous metal-ceramic composites prepared in the manner disclosed above are useful in applications wherein the range of the temperature of the environment, when endured for extended periods, has as its upper limit approximately 80 percent of the crystallization temperature of the amorphous phase. Further to the use of the process of the present invention as a means for fabrication of amorphous metal-ceramic composites, is the use of the as-prepared material as a starting point for the fabrication of metal-ceramic composites. This can be accomplished by reacting the amorphous metal-ceramic composite at a temperature above the crystallization temperature of the amorphous metal alloy, which will result in formation of a microcrystalline metal-ceramic composite. A microcrystalline metal-ceramic composite prepared by this method would retain the broad compositional range of its amorphous metal-ceramic composite precursor and would possess an even higher thermal stability than that precursor due to its crystalline state.

SPECIFIC EXAMPLES

The following examples are presented to more thoroughly explain the instant invention, but are not intended to be limitative thereof. The examples demonstrate the production of amorphous metal-ceramic composites by intimately mixing alloying elements by solid state reaction processes, in the presence of ceramic particles, and subsequently heat-treating the resultant composition to form a microstructure composed of ceramic particles in an amorphous solid matrix.

EXAMPLE 1

A solution of 10 mmol. of iron chloride, $FeCl_2 \cdot 4H_2O$, in 100 ml of $H_2O$ at room temperature was prepared. Into this solution, 100 mmol. of high surface area titanium boride, $TiB_2$, was suspended. A solution of 50 mmol. of $NaBH_4$ in 100 ml of $H_2O$ was added dropwise over a period of about 1.25 hours to the rapidly stirred suspension of $TiB_2/H_2O$-$FeCl_2.4H_2O$. During this reduction the evolution of hydrogen gas can be easily observed. The impregnated $TiB_2$, which formed immediately upon the addition of sodium borohydride to the iron chloride to produce a fine iron precipitate, was collected. This impregnated $TiB_2$ was washed with two 50 ml portions of water, then dried in vacuo for about 5 hours at 60 degrees Celcius. The resultant powder was compacted to the desired shape, and heat-treated at about 150 degrees Celcius for about 21 days. This yielded a crystalline microstructure consisting of about 90 atomic percent $TiB_2$, in a dilute amorphous metallic composition of Fe-Ti-B.

EXAMPLE 2

A solution of 10 mmol. of iron chloride, $FeCl_2 \cdot 4H_2O$, in 100 ml of $H_2O$ at room temperature was placed in a 400 ml beaker. This solution was heated to dissolve the $FeCl_2 \cdot 4H_2O$. It was then filtered through an F frit into a 500 ml Schlenk flask containing 45 mmol. of SiC, and was subsequently degassed. In an additional funnel, a solution of $NaBH_4$ in 100 ml of $H_2O$ was made and degassed. The $FeCl_2 \cdot 4H_2O$ solution was added dropwise over a period of about 1.25 hours, and then stirred overnight. The impregnated Fe/SiC that formed was allowed to settle out completely, and the water was then cannulated off. The precipitate was washed with two 50 ml. portions of water and then dried in vacuo at 60 degrees Celcius for 4 hours. This was stored and transferred in a dry box. Two resultant samples were sealed under vacuum and heat-treated, one at 290 degrees Celcius for 10 days and the other at 290 degrees Celcius for 21 days. A sample was submitted for x-ray diffraction comparison of the iron peak of the as-prepared material. The decreasing iron analysis and line of this comparison x-ray data indicated that iron was being taken into the amorphous phase. The composition of the analyzed material was $Fe_{10}Si_{45}C_{45}$.

The scope of this invention is intended to include modifications and variations commensurate with the scope of the appended claims. The parameters herein presented, such as the temperature and length of time of the heat-treatments, are not intended to be limitative.

What we claim is:

1. An amorphous metal-ceramic composite comprising about 75% to about 99.9% ceramic particles disposed in an amorphous metal matrix, said matrix formed by the solid state diffusion of a metal into the surface region of said ceramic particles to form said amorphous metal matrix.

2. The composite as in claim 1 wherein said ceramic particles comprise carbides, nitrides, oxides, and borides of Si, Al, Mo, Cr, W, Ti, V, Zr, HF, and combinations thereof.

3. The amorphous metal-ceramic composite as in claim 1 wherein said metal comproses Fe, Ni, Co, Cu and combinations thereof, which diffuse into said ceramic particles.

4. A process for the synthesis of an amorphous metal-ceramic composite, comprising intimately mixing alloying elements in the presence of ceramic particles and heat-treating this mixture to initiate a solid-state reaction-formation, said reaction-formation yielding a dual-phase microstructure composed of from about 75% to about 99.9% ceramic particles interspersed in an amorphous solid matrix binder.

5. The process as in claim 4 wherein said solid state reaction is a solid state incorporation/reduction reaction.

6. The process as in claim 4 wherein said mixture is heat-treated at a temperature between about 0.5 to about 0.8 of the glass transition temperature of the amorphous metal component of said amorphous metal-ceramic composite.

* * * * *